United States Patent [19]

Grant et al.

[11] 4,232,056

[45] Nov. 4, 1980

[54] THERMOSPRAY METHOD FOR PRODUCTION OF ALUMINUM POROUS BOILING SURFACES

[75] Inventors: Andrew C. Grant, Amherst; James W. Kern, North Tonawanda, both of N.Y.

[73] Assignee: Union Carbide Corporation, New York, N.Y.

[21] Appl. No.: 30,225

[22] Filed: Apr. 16, 1979

[51] Int. Cl.[3] ..... B05D 1/10

[52] U.S. Cl. ..... 427/37; 165/DIG. 10; 427/405; 427/422; 427/423; 428/937; 427/376.8

[58] Field of Search ..... 427/422, 423, 34, 37, 427/191, 192, 376 H, 405; 428/937; 239/1, 8, 79, 81; 165/DIG. 10

[56] References Cited

U.S. PATENT DOCUMENTS

| | | | |
|---|---|---|---|
| 2,788,290 | 4/1957 | Deuble | 428/937 X |
| 3,077,659 | 2/1963 | Holzwarth et al. | 427/423 X |
| 3,135,626 | 6/1964 | Moen et al. | 427/423 |
| 3,689,987 | 9/1972 | Teague | 427/423 X |
| 3,928,907 | 12/1975 | Chisholm | 427/423 X |
| 3,942,230 | 3/1976 | Nalband | 427/423 X |
| 3,961,098 | 6/1976 | Bessen | 427/423 X |
| 3,990,862 | 11/1976 | Dahl et al. | 165/134 |
| 4,093,755 | 6/1978 | Dahl et al. | 165/134 |

FOREIGN PATENT DOCUMENTS

| | | | |
|---|---|---|---|
| 492904 | 5/1953 | Canada | 427/423 |
| 2816283 | 10/1978 | Fed. Rep. of Germany | 427/423 |
| 623212 | 5/1949 | United Kingdom | 427/192 |

OTHER PUBLICATIONS

Arc Flame Spray System, Process Manual, Metco Inc., Westbury, L.I., N.Y. 1978, pp. 1-26.

*Primary Examiner*—Shrive P. Beck
*Attorney, Agent, or Firm*—Dominic J. Terminello

[57] ABSTRACT

A method for producing a porous boiling surface with exceptional adhesion qualities and mechanical strength while at the same time maintaining the high degree of open cell porosity required for effective boiling heat transfer wherein a bond coating of pure aluminum is produced using a thermospray gun to melt an aluminum wire and impinge the molten aluminum particles against the metallic substrate in an inert gas stream projected from the gun nozzle located between 2 and 4 inches from the substrate. The bond coating has a porosity of less than 15 percent and a thickness not greater than 4 mils. The nozzle to substrate distance is then increased to 4 to 10 inches and a top coating of pure aluminum is formed having a porosity greater than 18 percent and a thickness of at least four times the thickness of the bond coating.

9 Claims, No Drawings

THERMOSPRAY METHOD FOR PRODUCTION OF ALUMINUM POROUS BOILING SURFACES

FIELD OF THE INVENTION

This invention relates to a method for making aluminum porous boiling surfaces. More particularly, this invention relates to a method using thermospray guns of the electric arc or oxy-fuel gas type to melt an essentially pure aluminum wire to make a porous boiling surface consisting of a bond coat and a top coat.

PRIOR ART

It is well known that effective enhanced heat transfer surfaces for boiling require an open cell porosity such that the boiling fluid can undergo the phase change from liquid to vapor and the gas bubbles can disengage and be removed while the active sites are continually replenished by liquid. The structure of the surface must have certain characteristics as described by Milton U.S. Pat. No. 3,384,154. Basically, such effective boiling surface must have an average pore radius of given dimensions, a minimum porosity in order to have suitable density of active boiling sites and finally an interconnected cell structure to allow vapor escape and liquid replenishment of the active boiling sites. The prior art contains several means available to fabricate such porous boiling surfaces. These methods include sintering of a powder on suitable substrate as practiced for example in the Milton patent. Other alternates include combined sintering and subsequent etching or leaching of material from the coating to result in a porous surface. Still other means include flame spraying powders on suitable substrates to form the porous coating. All these fabrication techniques require very careful control of conditions in order to result in proper characteristics for the boiling surface and thereby are fairly expensive procedures. Additionally, the formation of particular porous boiling surface coatings involves additional special problems and corresponding procedures to avoid those problems. For example, the fabrication of aluminum porous boiling surfaces on metal substrates of either aluminum or other metals is an especially difficult problem due to the formation of oxides on the surface of aluminum. Some flame spraying prior art exists that claims to solve the problem associated with this oxide film as for example, Dahl et al. U.S. Pat. Nos. 3,990,862 and 4,093,755.

It should be noted that the utilization of aluminum for porous boiling surface is especially attractive because of its very favorable volumetric heat capacity. Thus, heat can be more effectively transferred through the coating and to the boiling sites within the coating relative to the use of other materials. Manufacturing techniques that utilize thermospray guns have the potential for economic production of aluminum porous boiling surface. Such techniques avoid the use of the bulky and expensive ovens normally required with brazing or sintering operations. Thermospraying metallic coatings is a complex function of gun type, feedstock, atomizing gas, nozzle to substrate distance, and spraying rates. Most of the existing prior art addresses the problem from the standpoint of rebuilding worn parts or coating for corrosion protection. Some prior art addressed to porous boiling surfaces (Thorne, British Pat. No. 1,388,733) involves considerable complexity including thermospraying special powder mixtures and metal leaching. Other prior art addressed to aluminum porous boiling surfaces (Dahl U.S. Pat. Nos. 3,990,862 and 4,093,755) claims that an oxygen rich atmosphere is beneficial. This art does not recognize the problem of adhesion and strength characteristics of the coating. The existing prior art does not disclose the combination of thermospray process parameters required to ensure the combination of coating adhesion, coating strength and coating boiling performance required for an effective aluminum porous boiling surface.

SUMMARY OF THE INVENTION

The invention is predicated on a methd of applying an aluminum porous boiling surface to metal substrates utilizing thermospray guns in an especially effective manner. The procedure minimizes pretreatment requirements for the metal substrate and further minimizes steps involved to form a satisfactory porous boiling surface. It has been found to be especially suitable for the application of aluminum to titanium and stainless steel substrates and it is expected to have similar advantages for other materials. The resultant porous boiling surface coating applied is effective from the standpoint of high performance boiling heat transfer and has very desirable mechanical properties. The high bonding strength and high strength of the coating itself is very favorable from the standpoint of maintaining coating integrity during fabrication of heat exchangers utilizing such coatings.

In its broad aspect the invention relates to an improved method of forming an aluminum porous boiling surface on a metal substrate. The improved technique involves the application of at least two distinct coatings to the metal substrate. The first or bond coating is applied to the metal substrate using either an oxy-fuel gas flame spraying gun (usually oxy-acetylene) or an electric arc gun with the use of an inert carrier gas, such as nitrogen, argon, or mixtures thereof. The gun nozzle distance from the metal substrate for this portion of the coating is relatively close to the metal substrate. The second or top coating is applied using an oxy-acetylene gun with nitrogen carrier gas at a position further removed from the metal substrate. Both coating steps utilize wire feedstock for the spray guns. One important characteristic of the method is the application of the bond coating in a manner such that it is of lesser porosity than the top coating. Basically, this bond coat application requires smaller distances between the gun and the substrate for the first coating compared to the second coating. Another characteristic of the improved method along with the use of the inert nitrogen carrier gas is the use of oxygen to acetylene feed gas ratios such that the flame produced is reducing. This feature enhances the maintenance of relatively oxide free molten particles prior to their attachment to the metal substrate. Other features associated with the method include suitable preparation of the metal substrate which requires grit blasting or other suitable means to roughen the surface of the substrate and may include acid-etching of the surface to reduce or remove oxide films.

The procedure described above is preferably practiced by placing the two or more guns at a fixed working station each being positioned the appropriate distance from the to-be-coated substrate and all wire, gas, and electrical utilities to the guns are connected. Additionally, the working station includes a dust hood to remove excess particles and gases. The station can have a suitable track and trolley arrangement to carry the metal substrate, as for example, a rotating tube past the fixed station and thereby coat the tube in one operation. This arrangement has obvious economic benefits. Although the above arrangement is preferred, it is possible to maintain a stationary to-be-coated piece and have a movable trolley with all associated guns. Still another option is to utilize hand-held spray guns for particular situations involving non-uniform and odd-shaped workpieces.

BEST MODE OF OPERATION

The process parameters that characterize the improved procedure involve the use of at least one gun which may be either an oxy-acetylene or electric arc type placed at about 3 inches from the working piece with possible range from as close as 2 inches to as far away as 4 inches to form the bond coat. The top coat is made preferably by an oxy-acetylene gun, its preferred distance from the working piece is 5 inches, but is could be as close as 4 inches and as far as 10 inches. Generally, the second gun will be at a distance ranging from 1.5 to 2.5 times the nozzle to substrate distance for the first gun with a preferred value of 1.7. The oxy-acetylene flame utilized is reducing and hence will have an oxygen to acetylene molar flow ratio of less than 2.5 with a preferred value of 2.0. The corresponding nitrogen carrier gas has a preferred flow range of 10 times the oxygen flow but could be as little as 5 times and as much as 15 times the oxygen flow rate. It should be understood that these values characterize the system, but many other combinations within the described ranges are possible and will depend on particular applications. However, the method is such that the bonding coat will have a porosity less than the outer heat transfer effective coat with porosities normally less than 15% for the bonding coat and greater than 18% for the top coat. Further, it should be understood that the top coat will have an open cell structure as required for effective heat transfer whereas the bonding coat may or may not have such open cell structure. A typical electric arc gun suitable for the practice of this invention is a consumable wire type gun wherein two wires are fed through the gun. An arc is struck between the wire electrodes thereby producing the heat required to melt the wire electrodes as the wires are advanced at an appropriate feed rate. The molten metal formed from the wire feedstock is atomized and propelled by a nitrogen gas stream flowing through the gun from behind the arc and thereby entraining the molten aluminum particles and carrying them forward until the particles impinge on the metal substrates.

A typical oxy-fuel gas gun includes a nozzle and appropriate mechanism for feeding the wire feedstock, which is the source of the metal particles, and all process gases. The heat energy required to melt the wire feedstock is formed from the combustion of fuel such as acetylene with an oxidizer such as oxygen. An inert carrier gas, preferably nitrogen, is directed through ports around the combustion flame and serves to shroud the metal and gas spray to prevent admixture with air. The nitrogen also aids in atomizing and propelling the metallic particles from the gun nozzle to the metal substrate.

The technology of thermospraying a porous boiling surface is a very complex technology. As previously described, it is important for the porous boiling surface to have a proper combination of adhesion to the base metal, general mechanical strength against erosion and handling, and finally the inherent high performance as a boiling surface. These requirements tend to be opposing to one another and thereby involve the utilization of particular conditions for each of the steps in order to ensure the desired result. One critical aspect of this invention was the realization that the need for these contrary requirements could be best met by a porous boiling surface of varying characteristics. Hence, the bond coating of the base metal substrate was made to enhance and increase the adhesion of the coating and the mechanical qualities of that coating. The top coating was made in such a manner to enhance the boiling characteristics of the coating while still at the same time maintaining suitable adhesion and mechanical strength qualities. Further, this invention depends on the understanding that the application of oxide-film forming metals such as aluminum to metal substrates such as aluminum or other metal substrates was best done at conditions that would minimize oxide formation. The particular steps associated with the coating includes the utilization of conditions which enhance a relatively dense and thin bond coat. This could be accomplished by spraying at a relatively close distance to the substrate. Generally, this was done at a gun nozzle to substrate distance of about 3 inches but this distance is expected to be a factor of many other conditions such as wire size, feedrate, oxygen fuel gas ratios, and carrier gas flowrates. Another characteristic associated with the improved method included the use of wire feedstocks made of essentially pure aluminum and thereby avoiding the inclusion of substantial oxide film as would be the case by utilizing a powder feedstock. Additionally, the improved method made the use of an inert nitrogen gas carrier which would again minimize presence of oxygen and thereby reduce oxide formation. Finally, when using thermospray guns that generate heat by oxidation of fuel, the oxygen and fuel feed rates are purposely held at a ratio to form reducing flames. The reducing flames were again expected to reduce oxide film formation. All the techniques utilized combine to form controlled melting, atomization, and propelling of metallic particles from the gun nozzle to the metal substrate in such a manner that oxide film formation was reduced or prevented. In addition to the advantages associated with wire feedstock related to low oxide content (relative to large surface area powders), it is believed that the wire feedstock results in more thorough heating and melting of the formed particles. This would lead to improved individual particle joining to the substrate and to other particles. The porosity of the bond and top coats were changed by regulating the gun nozzle to substrate distances. The relatively close distances utilized for the bond coat favored low porosity and adhesion and mechanical strength whereas the increased distances utilized for the top coat favored higher porosity. The higher porosity combined with the open cell structure favors effective performance as an enhanced boiling surface. All the above-described factors combine to result in an effective thermospray method of producing aluminum porous boiling surface with the proper balance of mechanical and thermal characteristics.

ADVANTAGES

The advantages of the described method can best be illustrated by describing some examples wherein the method was successfully utilized to apply porous boiling surfaces. These included the coating of titanium tubes using multiple passes of a single oxy-acetylene gun (Job 1); coating stainless steel tubes using a double pass of an oxy-acetylene gun (Job 2); and finally, coating of titanium tubes using a stationary work station with multiple guns (Job 3). For the case utilizing the stationary work station with multiple guns, the arrangement utilized one electric arc gun to apply the bond coat and two oxy-acetylene guns to apply the top coat. The gun nozzles were positioned so that they were aligned in the same horizontal plane as the axial centerline of the to-be-coated tube. Further, the gun nozzles were aligned perpendicular to the tube centerline. The electric arc gun nozzle was positioned 3 inches from the tube wall whereas each of the oxy-acetylene guns was positioned 5 inches from the tube wall. Further, each gun was laterally positioned 10 inches from the other guns. The rotating tube was moved past the fixed gun station so that the bond coat was applied first, followed by the other two guns applying the top coat. The arrangement utilized an automated start and stop sequence for the three guns so that the complete two part coating could be applied on the desired length of the rotating tube as it was laterally moved past the gun station. Other than at the ends of the to-be-coated tube length, all three guns operated simultaneously. All pertinent process conditions and parameters are set forth herewith in Tables 1 through 3.

The boiling heat transfer performance for one typical stainless steel tube (Job 2) was compared with surfaces made by prior art techniques. The results of the thermal comparison are shown in Table 4. It should be noted that each enhanced surface is compared to a plain substrate surface and that the degree of improvement with the present invention is about the same as prior art techniques even though the prior art teaches the necessity of high porosity for the porous surface.

TABLE 4

| | Job 2 | Milton '154 | Thorne '733 |
|---|---|---|---|
| Surface | Al on Stainless Steel | Al on Al | Cu. on Cu. |
| Technique for making surface | This Invention | Sintering | Flame Spray & Leaching |
| Thermal Performance (Refrigerant 11* at 1 atm. with heat flux of 10,000 Btu/hr sq. ft.) | | | |
| Enhanced Surface ΔT (°F.) | 2.9 | 3.0 | 2.7 |
| Plain Surface ΔT (°F.) | 20 | 37 | 21 |

*RF11 = trichloromonofluoromethane

In addition the surface of the invention was subjected to a standardized ASME test for stainless steel specifically ASME test SA-213 which involves tensile, flare, bending and flattening tests. The surface of the invention maintained integrity and did not crack or separate from the substrate.

Having described the invention with respect to a best mode of operation, it should be understood that minor modification may be made thereto without departing from the spirit and scope of the invention.

TABLE 1

PROCESS CONDITIONS FOR THERMOSPRAYING ALUMINUM POROUS BOILING SURFACES

| Job | 1 | 2 | 3 |
|---|---|---|---|
| Materials | Al on Ti | Al on 304L SS | Al on Ti |
| Substrate Preparation | | | |
| Grit Blast | Yes | Yes | Yes |
| Acid Etch | Yes | No | No |
| Base Coat | | | |
| Gun Type | Oxy-Acetylene | Oxy-Acetylene | Electric Arc |
| Nozzle Distance | 4 inches | 3 inches | 3 inches |
| Carrier Gas | Nitrogen | Nitrogen | Nitrogen |
| Feedstock | Wire | Wire | Wire |
| Flame Type | Reducing | Reducing | — |
| Passes | 1 | 1 | 1* |
| Top Coat | | | |
| Gun Type | Oxy-Acetylene | Oxy-Acetylene | Oxy-Acetylene |
| Nozzle Distance | 10 inches | 5 inches | 5 inches |
| Carrier Gas | Nitrogen | Nitrogen | Nitrogen |
| Feedstock | Wire | Wire | Wire |
| Flame Type | Reducing | Reducing | Reducing |
| Passes | 4 | 1 | 2* |

*With multiple guns

TABLE 2

PROCESS PARAMETERS FOR THERMOSPRAYING ALUMINUM POROUS BOILING SURFACES

| Job | 1 | 2 | 3 |
|---|---|---|---|
| Tube Size | | | |
| Diameter (ins) | 1.5 | 0.75 | 1.0 |
| Wall Thickness (mils) | 35 | 65 | 28 |
| Coated Length (ft) | 4.2 | 22.5 | 34.6 |
| Tube Preparation | | | |
| Grit Blast Material | No. 24 $Al_2O_3$ | No. 24 Steel | No. 36 $Al_2O_3$ |
| Depth (mils) | 2 to 3 | 3 to 4 | 2 to 3 |
| Etching | Acidic | — | — |
| Bond Coat Parameters | | | |
| Gun Type | Oxy-Acetylene | Oxy-Acetylene | Electric Arc |
| Nitrogen Gas (scfh) | 1400 | 1200 | 1500 |
| Oxygen Gas (scfh) | 90 | 100 | — |
| Acetylene Gas (scfh) | 40 | 50 | — |
| Electric Power (amps) | | — | 85 |
| (volts) | | — | 28 |
| Wire Type | ⅛" Al | ⅛" Al | Two 14 ga. Al |
| Wire Feed Rate (ft/min) | 9.4 | 3.8 | 6 |
| Travel Speed (ft/min) | 4 | 14.8 | 7 |
| Tube Speed (rpm) | 400 | 150 | 250 |
| Top Coat Parameters | | | |
| Gun Type | Oxy-Acetylene | Oxy-Acetylene | Oxy-Acetylene |
| Nitrogen Gas (scfh) | 1400 | 1200 | 1200 |
| Oxygen (scfh) | 90 | 100 | 100 |
| Acetylene (scfh) | 40 | 50 | 50 |
| Wire Type | ⅛" Al | ⅛" Al | ⅛" Al |
| Wire Feed Rate (ft/min) | 12.7 | 8.8 | 8 |

TABLE 2-continued

PROCESS PARAMETERS FOR THERMOSPRAYING ALUMINUM POROUS BOILING SURFACES

| Job | 1 | 2 | 3 |
|---|---|---|---|
| Travel Speed (ft/min) | 4 | 4.3 | 7 |
| Tube Speed (rpm) | 400 | 150 | 250 |

TABLE 3

COATING PARAMETERS FOR THERMOSPRAYED ALUMINUM POROUS BOILING SURFACES

| Job | 1 | 2 | 3 |
|---|---|---|---|
| Base Coat | | | |
| Thickness (mils) | 2 | 0.9 | 2 |
| Porosity (%) | — | 10 | — |
| Top Coat | | | |
| Thickness (mils) | 22 | 8.1 | 15 |
| Porosity | — | 22 | — |
| Mechanical Factors | | | |
| Visual Appearance | Excellent | Excellent | Excellent |
| Strength | Fair | Good | Excellent |
| Thermal Factors | | | |
| Heat Flux (BTU/hr ft$^2$) | 10,000 | 10,000 | 10,000 |
| Temp Diff. (°F.) for Typical Refrigerant | 2.5 | 2.9 | 2.9 |

What is claimed is:

1. Method for making an aluminum porous boiling surface having an open cell structure top coating on a metal substrate comprising (a) melting an essentially pure aluminum oxide free wire by means of a thermospray gun;

(b) entraining said molten aluminum in an inert gas stream to shield from the surrounding atmosphere, and thereby minimize oxide formation, atomize, and transport, such atomized aluminum particles;

(c) positioning said thermospray gun so that the nozzle to substrate distance is in the range of about 2 to 4 inches;

(d) impinging said inert gas stream containing the aluminum particles on said metal substrate to form bond coating having less than 15 percent porosity and having a thickness of not greater than 4 mils;

(e) than increasing the nozzle to substrate distance to a distance in the range of from 4 to 10 inches; and (f) impinging said inert gas stream containing the aluminum particles on said bond coating to form an open cell structure essentially oxide free top coating, having porosity of greater than 18% and having a thickness of at least four times the thickness of the bond coating, thereby producing a porous boiling surface having sufficient open cell porosity required for effective performance as a boiling surface while exhibiting good adhesion and mechanical strength.

2. Method according to claim 1 wherein the thermospray gun used to produce the bond coating is an electric arc spray gun and the thermospray gun used to produce the top coating is an oxy-fuel gun.

3. Method according to claim 1 wherein the thermospray gun for producing both the bond coat and the top coat is an oxy-fuel gun.

4. Method according to claim 1 wherein the thermospray gun for producing both the bond coat and top coat is an electric arc spray gun.

5. Method according to claim 1 wherein the inert gas is nitrogen.

6. Method according to claim 1 wherein the nozzle to work distance for the bond coating is 3 inches and the nozzle to work distance for the top coating is 5 inches.

7. Method according to claim 1 wherein the nozzle to work distance for forming the top coating is about 1.7 times the nozzle to work distance used for forming the bond coating.

8. Method according to claim 1 or 3 wherein the fuel in the oxy-fuel gun is acetylene.

9. Method according to claim 1 or 3 wherein the oxy-fuel flow is reducing in nature.

* * * * *